United States Patent [19]

Blosseville et al.

[11] Patent Number: 4,977,721

[45] Date of Patent: Dec. 18, 1990

[54] RIGID COVERING FOR ROOFS AND SUPPORTS THEREFOR

[75] Inventors: Patrick Blosseville; Claude Dubrac, both of Fourges, France

[73] Assignee: Vieille Montagne France S.A., Bagnolet, France

[21] Appl. No.: 457,104

[22] Filed: Dec. 26, 1989

[30] Foreign Application Priority Data

Jul. 26, 1989 [FR] France ..... 89 10071

[51] Int. Cl.[5] ..... E04D 1/34

[52] U.S. Cl. ..... 52/410; 52/409; 52/199; 52/545

[58] Field of Search ..... 52/199, 409, 410, 545

[56] References Cited

U.S. PATENT DOCUMENTS

| | | | |
|---|---|---|---|
| 277,254 | 5/1883 | Fitzberger | 52/545 X |
| 2,357,705 | 9/1944 | Thorne | 52/199 X |
| 2,959,897 | 11/1960 | Baker | 52/409 |
| 4,090,435 | 3/1978 | Vallée | 52/199 X |
| 4,280,399 | 7/1981 | Cunning | 52/199 X |
| 4,528,789 | 7/1985 | Simpson | 52/409 X |
| 4,643,080 | 2/1987 | Trostle | 52/199 X |
| 4,651,489 | 3/1987 | Hodges | 52/409 |
| 4,706,434 | 11/1987 | Cotter | 52/545 X |
| 4,718,211 | 1/1988 | Russell | 52/409 |
| 4,741,142 | 5/1988 | Otto | 52/545 X |
| 4,833,853 | 5/1989 | Deibele | 52/410 |
| 4,870,798 | 10/1989 | Richter | 52/545 X |

FOREIGN PATENT DOCUMENTS

| | | | |
|---|---|---|---|
| 548233 | 11/1930 | Fed. Rep. of Germany | 52/409 |
| 2903897 | 8/1980 | Fed. Rep. of Germany | 52/410 |

*Primary Examiner*—Richard E. Chilcot, Jr.
*Assistant Examiner*—Deborah McGann Ripley
*Attorney, Agent, or Firm*—Marvin E. Jacobs

[57] ABSTRACT

A roof system is provided for buildings having an unventilated roofing support such as concrete forming a planar receiving surface. An intermediate plate formed of an environmental-tight sheet of plastic material is placed on the planar receiving surface. The sheet contains a uniform pattern of protuberances such as frustoconical studs having planar tops. A rigid roof covering formed of corrosion-resistant metal plates such as zinc is laid on top of the planar surfaces of the studs. The plates have interfitting, bent edges forming troughs. The studs space the rigid roof covering from the intermediate sheet forming a ventilation space for collecting leaks or condensation.

6 Claims, 2 Drawing Sheets

RIGID COVERING FOR ROOFS AND SUPPORTS THEREFOR

BACKGROUND OF THE INVENTION

Field of the Invention

The present invention relates to a metallic covering for the roof of buildings, which is laid on an unventilated roof support, for example formed of rigid concrete forming a flat receiving surface. The covering is constructed of rigid plates, usually formed of metal preferably a corrosion-resistant metal such as zinc. The plates are designed to interlock in a mating fashion with each other forming troughs running in the direction of the slope of the roof. It also relates to right-angled supports for the covering in accordance with the invention.

Roof coverings in zinc are now employed for roofing or boarding or guttering in highly corrosive industrial environments and in very polluted urban environments. The roof frames for such roof coverings are in general no longer made of wood wood provided ventilation for high-priced or city roofs in previous centuries. The roof frames are now made of concrete which in theory constitutes a stronger, longer lasting material than wood. Numerous instances of corrosion in such roofs laid on supports in concrete have nevertheless been reported. Such corrosion is not only the result of the aggressive atmosphere to which such roofs are exposed but also results from the supports which are inserted between the metallic plates (zinc, copper, galvanized or stainless steel, aluminium, etc.) and which most commonly are not wood and comprise, rather, roofing felts and non-woven materials. These materials foater acid reactions when soaked with the aqueous medium resulting from condensation.

In order to overcome the difficulties currently encountered in coverings such as roofing, boarding or guttering constructed using rigid plates laid on unventilated and rigid supports, such as concrete sections, it appeared to be necessary to improve ventilation between the under part of the roof and the rigid plates in order to avoid condensation, and if the plates are formed of metal, to isolate them from the unventilated roofing support, particularly in the case where the support is is formed concrete, using a neutral material which is more resistant to acid and corrosive reactions in an aqueous medium.

SUMMARY OF THE INVENTION

To this purpose, in accordance with the invention, intermediate plates are fixed directly to an unventilated support forming a continuous vapor-tight, planar receiving surface. The intermediate plates are formed of a soft and elastic material which absorbs expansion, which maintain its strength for long periods of time and is electrically and chemically non-corrosive with regard to the rigid plates. The intermediate plates can be a plastics material. The plates are fixed directly onto the unventilated support using tubular fastening means or screws which pass through the plate in a sealing manner. The head of the screw bears against the plate. The rigid plates are attached to support members laid on the intermediate plates and fixed to the rigid support using tubular fastening means or screws passing in a sealed manner through said intermediate plates surface protuberances or spacing elements which are regularly distributed on said intermediate plates are interposed between the rigid plates and the intermediate plates so as to provide a ventilation space under the rigid plates. The assembly of intermediate plates can be used as an under-roof assembly adapted to recover leaks and possible condensation from the main roofing structure formed by the rigid plates.

In another embodiment of the invention, the support members for the rigid plate are fixed to the intermediate plates and bear on surface protuberances or spacing elements thereby forming a ventilation space under the support members. A members, for the rigid plate are fixed to the intermediate plates whilst bearing on surface irregularities or spacing elements with the interpositioning, at least in some places, of a sealing and/or support element such as a seal formed of an elastomer foam can be positioned between the support members, and the intermediate plate. The surface protuberances or spacing elements are preferably an integral part of the intermediate plate and may accomodate, at least in part, the expansion of said intermediate plate. The surface protuberances or spacing elements integral with the intermediate plate are advantageously formed of studs of hollow frustro-conical shape having a substantially planar head which are regularly distributed in a projecting manner on one side of the planar plate suitably, formed of a thin plastic material.

In yet a further embodiment of the invention, support members exhibit a right-angled cross section one arm of which is adapted to be laid flat on the planar heads of several adjacent studs of frustro-conical shape said arm is provided with frustroconical-shaped cavities the minor base of which is directed to the side opposite the other arm of the support member. The other arm is adapted to cooperate with the rigid plates. The cavities of frustro-conical shape project by an extent which is substantially equal to the height of projection of the frustro-conical shaped portions of the intermediate plate, so that said arm is able to bear simultaneously on the planar heads of the frustro-conical portions of the intermediate plate and, at the base of these frustro-conical shaped cavities, directly on the intermediate plate. The minor base of the frustro-conical shaped cavities of the arm of the support members generally includes a hole into which a tubular fastening means or screw is engaged in order to fix the support member onto the unventilated support. The tubular fastening means or screws passing through the intermediate plates are substantially sealed at the point of passage through the plates by virtue simply of the tight fit between the periphery of these tubular fastening means or screws and the wall of a circular hole provided in the plates, the material of which is much more yielding than the metal forming said tubular fastening means or screws.

The invention also provides a support for a rigid covering, having a generally right-angled cross-section and being adapted to be fixed by one of its arms onto a receiving surface, and in which the arm intended for said fixing is provided with cavities of frustro-conical shape the minor base of which is directed to the side opposite the other arm of the right-angled section and in which the substantially flat surface of the minor base constitutes an abutment and fixing surface onto this receiving surface. The minor base of the frustro-conical portions include a hole for the passage of a fixing means providing attachment to the receiving surface.

BRIEF DESCRIPTION OF THE DRAWINGS

Other aims advantages and characteristics of the invention will become more clear from the description which follows of several embodiments of the invention which should be considered as having a non-limiting nature and with reference to the attached drawings in which.

DESCRIPTION OF PREFERRED EMBODIMENTS

Figure 4:
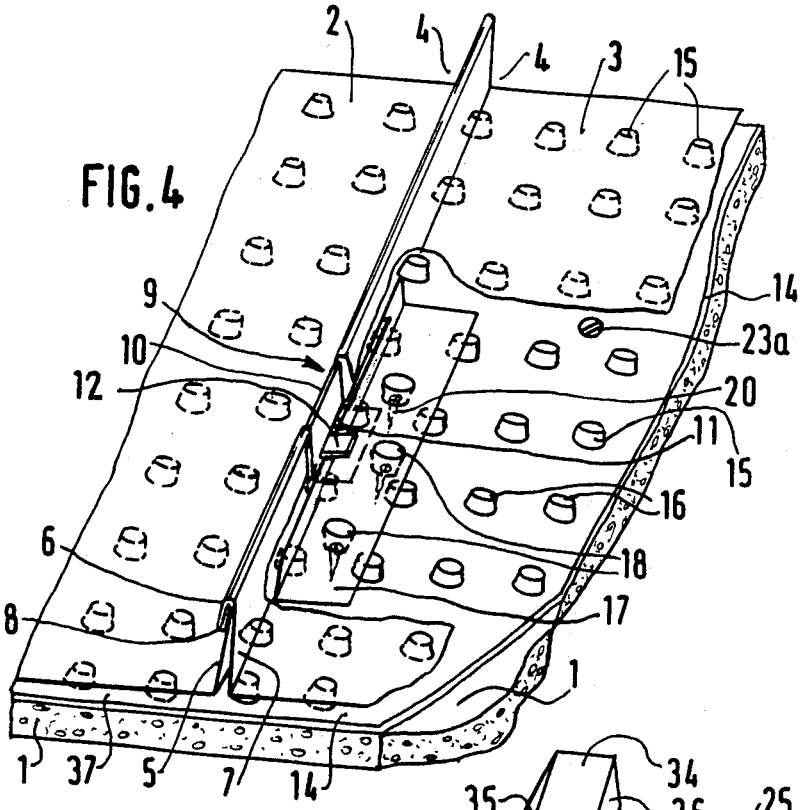
FIG. 4 is a perspective view, partially torn away and on a smaller scale of two metallic plates which are mutually interconnected, for a roofing in accordance with the invention layed on an intermediate plate carrying studs in the form of truncated cones.

With reference first to FIG. 4, the main components of a zinc roofs are shown, the roof being laid an unventilated concrete support 1 which forms a rigid flat receiving surface. Adjacent zinc plates 2 and 3 form a central trough 4 which runs in the direction of slope of the roof in order to discharge rainwater to a drain. These zinc plates 2 and 3 which can overlap at the end portions, exhibit, on their lateral sides, differing folds which interfit. The right hand fold 5 (in the sense of the drawing) exhibits a right-angled wall with an edge 6 folded over on itself once. The left hand fold 7 (shown on plate 3) is folded back on itself twice on the edge 8, in order to surround the edge 6 of the plate 2 and to prevent any overrunning of water in the case of heavy rain.

Figure 3:
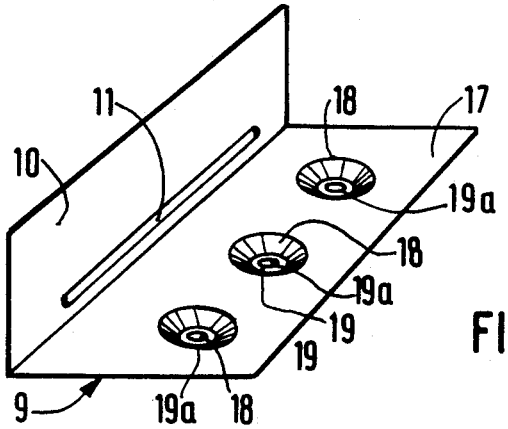
FIG. 3 is a perspective view of the support piece seen in section in FIG. 2.

The right and left hand folds 5 and 7 of the two adjacent zinc plates 2 and 3 engage a support piece 9 (see FIG. 3) which takes the general form of a right-angled piece one arm 10 of which is arranged vertically between the two vertical walls of the folds 5 and 7. The arm 10 is provided with a longitudinal slot 11 into which the tabs 12 of hook members (not shown) engage, the hook members being crimped onto the vertical walls of the edge folds 5 and 7.

Figure 1:
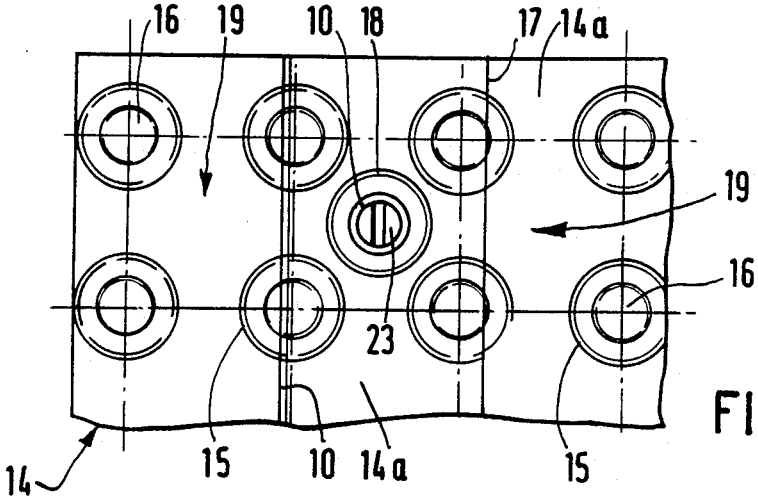
FIG. 1 is a top view of a portion of intermediate plate used for a metallic covering in accordance with the invention.
Figure 2:
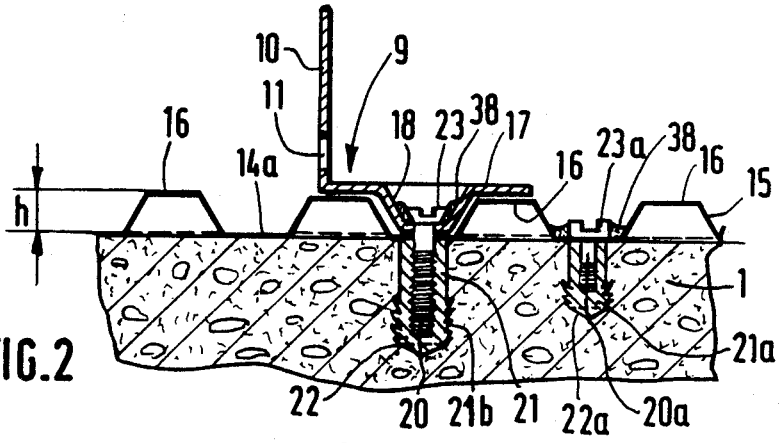
FIG. 2 is a sectional view of the portion of intermediate plate shown in FIG. 1 on which a right-angled support piece has been layed, fixed by screws to a rigid roofing support in concrete.

In accordance with the invention, the metallic plates 2 and 3 are laid on intermediate plates 14 in the form of a a sheet laid flat on the rigid concrete support 1. The sheets have protrusions on their surface which are directed towards the metallic plates 2 and 3. The surface protuberances can be in the form of studs 15 having a generally frustro-conical shape with their flat minor base 16 uppermost. In FIGS. 1 and 2 it can be seen how each intermediate plate 14 comprises a continuous plate formed of a plastic material 14*a*. Surface protuberances 15 are suitably formed in the body of the sheet by thermoforming. The protuberances 15 in the form of truncated cones constitute, on the back surface of the plate 14, projecting studs of limited height h comprised between 5 and 10 mm. In an advantageous embodiment, a plate formed of plastic material can be used which takes the form of a sheet having a thickness comprised in the range 0.5 to 1 mm and the truncated conical studs have a major base diameter comprised between 15 and 20 mm and a minor base diameter between 8 and 12 mm, the spacing between the studs being comprised between 25 and 40 mm, the studs being preferably arranged in a square pattern.

In FIG. 2, the fixing arrangement of the support piece 9 onto the rigid concrete support 1 can be seen. The support piece 9 can be made of a material which is highly resistant to corrosion such as stainless steel and can take the the form of a right-angled part 1. The other arm 17 of the support piece 9 is provided with several frustro-conical cavities or recesses 18 formed by cold forming. The cavities 18 are adapted to be positioned in the a spaces 19*b* provided between series of four frustro-conical studs 15 (see FIG. 1) while the remainder of the arm 17 bears on two adjacent planar surfaces 16 of the frustro-conical studs 15. The base 19 of the cavity 18 (see FIG. 3) is supported on the planar base portion 16 at the intermediate plate 14 where it is fixed by means of a screw 20 passing through a hole 19*a* provided through the base 19 (see FIG. 3) and which is screwed, for example, into an expansion plug 21 formed of a plastic material, which is force mounted and is provided with anti-pullout hooks 21*b* inside a hole 22 drilled in the concrete of the rigid support 1.

In order to provide fixing of the intermediate plate 14 at other points onto the rigid concrete support 1, screws 20*a* are provided which are regularly spaced and screwed into expansion sleeves 21*a*, if necessary shorter than the sleeve 21. The sleeves are force fitted in holes 22*a* drilled in the concrete 1. The head 23*a* of the screws 20*a* bears on the planar surface of the plate 14*a* either directly or via a flexible but rigid washer and can if necessary be surrounded by a waterproofing layer suitably formed of an elastomer material 38. The shank of the screws 20 and 20*a* can pass through a hole in the plate 14 which is drilled to a diameter slightly less than the diameter of the screw shank so that the elasticity of the walls of the hole ensure that the material of the plate 14 provides a sealing clamping effect which is relatively soft nevertheless, on the shank of the screw 20 or 20*a*. The heads 23, 23*a*, of the screws 20 and 20*a* may, if necessary, be rendered water-tight on the base of the cavity 18 by the insertion of an elastomer material surrounding the head of the screw.

In FIG. 4, the various elements of the roof are shown in FIGS. 1 to 3 will be seen again on a smaller scale. Each screw that is placed can be rendered water-tight at its head by the use of a layer of an elastomer-based liquid 38 which spreads around the head of screw 23 or 23*a* (see FIG. 2).

Figure 5:
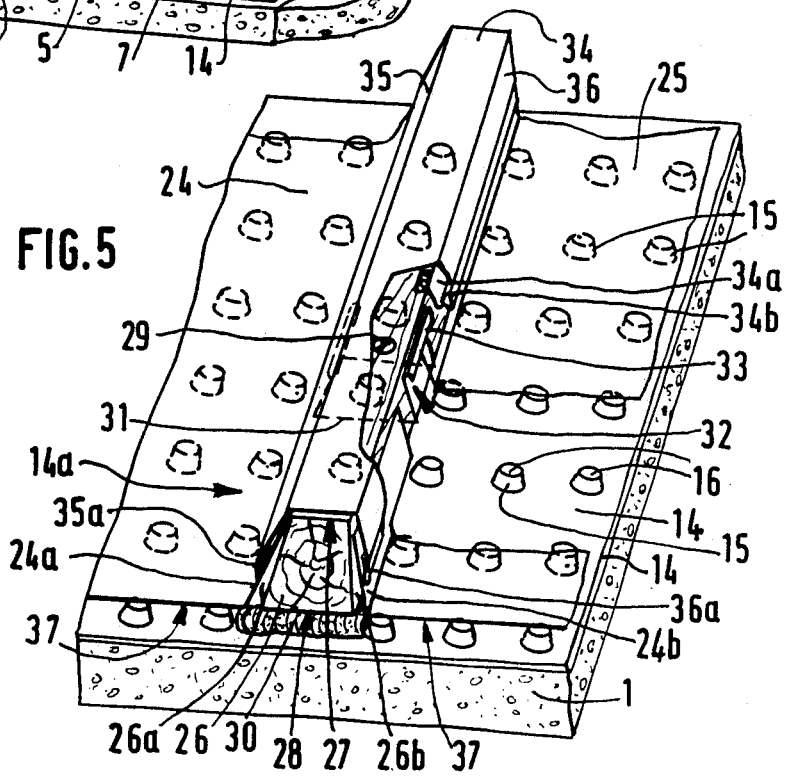
FIG. 5 is a perspective view, partially torn away and on a smaller scale of a roof in accordance with the invention constructed using metallic plates in the form of trays assembled pairwise on a joining strip or batten which is raised and employed for conventional zinc roofs.

The roof shown in FIG. 5, which corresponds more closely to a conventional way of laying zinc roof coverings, employs symmetrical zinc plates 24, 25 in the form of trays. Between two adjoining zinc plates in the form of trays, a joining strip or batten 26 generally made of wood, is fixed onto the intermediate plates 14 provided with studs 15. The joining strip 26 which is laid in the direction of slope of the roof, here has a trapezoidal cross-section with its minor base 27 uppermost and its major base 28 lowermost which is laid on the planar sides 16 of the frustro-conical studs 15. The joining strip 26 may also exhibit a rectangular or square cross-section or or the like, and is fixed onto the rigid concrete support 1 by means of screws 29 which are generally screwed into sleeves held rigidly in the concrete such as the sleeve 21 shown in FIG. 2. The screws 29 should pass through the intermediate plate 14 in a sealed manner and a sealing joint 30 formed of elastomer foam can be inserted under the joining strip 26 between the generally planar portion of the intermediate plate 14 and the major base 28 of the joining strip. This sealing joint formed of elastomer material simultaneously ensures better load bearing characteristics of the strip on the plate 14 than those provided by the studs 15 which can suffer spreading out at certain points. While fixing the joining strips 26 onto the intermediate plate 14, under the major base 28, the U-shaped arm 31, of double hooks 32 can be inserted, the upper folded-over portion 33 of which can come into engagement with the raised edge portions 24*a* and 24*b* of the trays 24 and 25 thus opposing their extraction in the upward direction. In order to maintain in place a trough-sectioned covering element 34 covering the joining strip 26 and oppose its extraction in the upward sense, hooks 34*a* which are nailed onto the joining strip 26 can be provided. Each trough-sectioned piece of roof 34 which is also formed of zinc may be provided at its extreme edges with folded-over portions 35*a* and 36*a* which engage with the folded-over edges 34*b* of the hooks 34*a*. The trough-sectioned portion 34 can also be held in place by hooks fixed onto the bottom of the joining strip 26 and folded over onto one end of the trough-sectioned portion 34.

When mounting the tray-shaped metallic plates 24 and 25, the raised edge portions 24*a* and 24*b* of these plates slide under the lateral strip portions 35 and 36 of the trough-sectioned portion 34, and are held in position by double hook members 32 which can obviously be replaced by single hook members which for example are nailed onto the inclined lateral sides 26*a* and 26*b* of the wooden joining strip 26. The tray-shaped zinc roofing elements 24 and 25 which are oriented in the direction of greatest slope of the roof are covered by the lateral strip portions 35 and 36 of the trough-sectioned portion 34, which ensures good protection against rising up of water under the action of the wind. Laying of the zinc tray-shaped elements 24 and 25 hence makes provision for free expansion of the metallic plates in all directions which is essential as the temperature of the zinc can vary between 80° C. in the full sun in summer and −20° C. in winter. The zinc tray-shaped members 24 and 25 are moreover laid on the planar heads 16 of the studs 15 which provide a ventilation space 37 of the same vertical height as the degree of projection h of the studs 15 (over the planar portion 14*a* of the intermediate plates 14) between these intermediate plates and the metallic covering plates (see also the ventilation space 37 in FIG. 4).

The assembly of intermediate plates constitutes a combined assembly which is sealed in regards to the flow of water in the direction of the slope of the roof and which can perform the function of an under-roof surface which recovers small leaks and possible condensation from the metallic plates, and lead such water off to the drain. The method of laying shown in FIG. 5 can be adapted, in certain countries which do not use wood, to the use of wholely metallic battens which are layed as intermediate pieces between the tray-shaped zinc elements having flanged vertical lateral sides. The metallic batten is made up by a U-shaped continuous element also made of zinc and laid using the joining arm of the U (the arms of the U being vertical) on the rigid concrete support 1 upon which it is fixed by any suitable means such as screws or nails.

After fitting the U-shaped member, the vertically-directed arms of which have upper folded over edges which are placed against a flange on the lateral sides of the tray-shaped zinc elements, the projecting arms of the U-shaped element are closed of by means of a covering plate formed of zinc which covers it and also possesses flanges. The successive super-positioning of the flanges of the covering plate, the U-shaped section and the vertical side of the adjacent tray-shaped zinc roofing element are then folded-over together in the vertical sense, in order to simultaneously, seal the tray-shaped element, the covering plate and the joining strip against projected water. When the invention is applied to metallic joining strips or battens having a U-shaped profile as described above, the U-shaped profile of the batten is fixed onto the intermediate plate 14 with local insertion of a simple sealing joint such as the seal 30, in order to also provide a ventilation space 37 under the metallic U-shaped battens.

Laying of a roof according to the invention onto a rigid support such as concrete or a metallic structure starts with the laying of the intermediate plates 14 which mutually overlap at their edges in all four directions and are held onto the metallic support generally by means of screws the passage of which is rendered sealing by direct contact with the plastic material of the intermediate plate 14 or, if needed, with the interpositioning of an elastomer seal 38 between the head of the screw and the intermediate plate. The intermediate plates having been laid, intermediate supports 9 can now be fixed in place, or battens 26 or trough-sectioned elements 34 depending on the type of metallic plate selected. Once the support parts 9 or 26 are in place, the metallic plates can now be laid which are slid laterally one inside the other in the direction of the slope of the roof. The metallic plates come to rest on the planar heads 16 of the studs 15 forming a ventilation space 37 which prevents condensation occurring below the zinc and the starting of corrosion in association with an acidic aqueous phase, the risk of which is reduced due to the fact that the intermediate plates 14 are made of plastic material that does not corrode.

It is well understood that the examples and alternatives given in the foregoing description are adaptable to numerous variants available to those skilled in the art without in any way departing from the scope and spirit of the invention.

We claim:

1. A roof system for application to an unventilated roofing support forming a planar receiving surface, comprising in combination:

a continuous, intermediate plate formed of a plastic material capable of absorbing expansion and of isolating the roofing support from the environment, said plastic having high strength, being durable and not causing chemical electrical corrosion with the metal covering;

a uniform pattern of hollow, frusto-conical plastic studs having a substantially planar head integral with and projecting from one side of said plate forming spacing elements;

means for attaching the plate directly to the support by fastening elements sealingly received through the plate;

support members disposed on the intermediate plate and fastening means sealingly received through the intermediate plate into the roofing support for fastening the support members to the roofing support; and a metal covering formed of a plurality of corrosion-resistant metal plates having upstanding interfitting edges forming troughs therebetween running in the direction of the slope of the roof, said covering being laid on the planar heads of said studs and supported by said support members forming a ventilation space between the metal covering and the intermediate plate for capturing leaks and condensation from the metal roof covering.

2. A roof system according to claim 1 in which the metal comprises zinc and the roofing support is formed of concrete.

3. A roof system according to claim 1 wherein the support members contain two right-angled disposed arms, a first arm of which is adapted to be laid flat on the planar heads of several adjacent studs, said first arm being provided with frusto conical shaped cavities the smaller base of which is directed toward the side opposite the second arm of the support member and which is adapted to cooperate with the metal plates and wherein said cavities of frusto-conical shape project by an extent which is equal to the height of projection of the frusto-conical shaped studs of the intermediate plate, whereby said second arm is able to bear simultaneously on the planar heads of the frusto-conical studs of the intermediate plate and on the base of the frusto-conical shaped cavities which are directly in contact with the intermediate plate.

4. A metal covering according to claim 3, wherein the smaller base of the frusto-conical shaped cavities of said arm of the support member includes a hole into which a fastening element can be engaged to fix the support member onto the unventilated roofing support.

5. A roof system according to claim 1, wherein the plastic intermediate plate includes a circular hole and the fastening means is formed of metal and passes through the hole in the intermediate sealing means being provided at the point of passage through said plates by a tight fit between the periphery of the metal fastening means and the plastic wall of said circular hole provided in the intermediate plates.

6. A roof system according to claim 1, in which said support member has two right-angled disposed arms, the first arm being adapted to be fixed onto the receiving surface of the roofing support, said first arm being provided with cavities of frusto-conical shape, the small flat base of which is disposed to the side opposite the second arm of the support member and wherein the flat bottom surface of the small base forms an abutment and attaching surface laid on the receiving surface, said second arm including a hole for the passage of a fixing means providing attachment to the receiving surface.

* * * * *